US006219847B1

(12) United States Patent
Aikins

(10) Patent No.: US 6,219,847 B1
(45) Date of Patent: Apr. 24, 2001

(54) COCOON GARMENT

(76) Inventor: Donna L. Aikins, 1105 Funston Ave., Pacific Grove, CA (US) 93950

( * ) Notice: Subject to any disclaimer, the term of this patent is extended or adjusted under 35 U.S.C. 154(b) by 0 days.

(21) Appl. No.: 09/576,372

(22) Filed: May 22, 2000

(51) Int. Cl.[7] ..... A41D 11/00
(52) U.S. Cl. ..... 2/69; 2/69.5; 2/80
(58) Field of Search ..... 2/69, 69.5, 80, 2/83, 85, 93, 78.1, 114, 89, 94, 129, 115, 116

(56) References Cited

U.S. PATENT DOCUMENTS

| | | | | |
|---|---|---|---|---|
| 2,478,239 | * | 8/1949 | Chinn . | |
| 2,562,061 | * | 7/1951 | Peterson . | |
| 2,579,276 | * | 12/1951 | Schworm | 2/80 |
| 2,723,398 | * | 11/1955 | Tuteur . | |
| 2,967,306 | * | 1/1961 | Fabanich | 2/69 |
| 3,812,539 | * | 5/1974 | Muehlberg et al. | 2/69.5 |
| 4,083,064 | * | 4/1978 | Schneider | 2/69.5 |
| 4,240,159 | * | 12/1980 | Wrightson | 2/69 |
| 4,507,805 | * | 4/1985 | Calutoiu | 2/69.5 |
| 4,759,082 | * | 7/1988 | Mulligan | 2/69.5 |
| 4,901,371 | * | 2/1990 | Christians | 2/69.5 |
| 4,932,077 | | 6/1990 | Dobbs . | |
| 5,560,043 | * | 10/1996 | Armstrong | 2/69.5 |
| 5,611,082 | * | 3/1997 | Bull | 2/79 |
| 5,621,917 | * | 4/1997 | Howsden | 2/111 |
| 5,970,542 | | 10/1999 | Mays . | |
| 6,061,831 | * | 5/2000 | Rudolph et al. | 2/69.5 |
| 6,076,186 | * | 6/2000 | Grose | 2/75 |

OTHER PUBLICATIONS

"One Piece Polartec Lounger" on p. 47 of the Lands End catalog, Christmas 1998.
"Body Quilt" on p.116 of the Lillian Vernon catalog, Christmas 1998.

* cited by examiner

*Primary Examiner*—Gloria M. Hale
(74) *Attorney, Agent, or Firm*—Jack Lo

(57) ABSTRACT

The present cocoon garment is comprised of a tubular body continuously extending between a shoulder end and a feet end for fully covering the torso and legs. A neck opening is provided at the center of the shoulder end, and is cut lower at the front than at the back for comfort. A pair of sleeves is attached to opposite sides of the shoulder end for covering the arms. A center pocket is provided at the front of the tubular body, and includes openings on opposite sides for receiving the hands. A longitudinal slit is provided on the back of the tubular body for entry and exit, even when sitting or lying down. The slit is completely free of fasteners for comfort when sitting or lying on it. Since a person would be mostly sitting or lying down when wearing the garment, the slit does not need to be closed with fasteners anyway. The feet end is removed from the legs for walking. The loose feet end can be raised to avoid tripping by tying it to a higher portion of the garment with cords.

2 Claims, 4 Drawing Sheets

COCOON GARMENT

BACKGROUND OF THE INVENTION

1. Field of the Invention

This invention relates generally to garments.

2. Prior Art

People like to wear warm, comfortable garments at home in cold weather. Instead of bulky clothes, some people prefer to wrap themselves in a blanket when reading, watching television, or lounging around. Although blankets are comfortable, they are cumbersome to handle, and they tend to uncover parts of the body or fall off when the wearer shifts or stands up. Wearers must constantly struggle with them.

One-piece lounging garments are known in the prior art for covering most of the body without falling off. They typically include front closures with fasteners, such as zippers, buttons, or snaps. Some have separate side pockets for warming the hands, and some have holes at the feet end for the feet to stick out. However, the front closures require the wearer to stand up to put them on or take them off. This is at least inconvenient for able and healthy people, and quite difficult for elderly, wheelchair bound, or bedridden people. They cannot be worn backward because the collars are cut higher at the back than at the front, which makes the collars uncomfortable to wear in a reversed position. Even if they are worn backward with the front closure on the back, the fasteners on the closure would be difficult to reach and operate, especially for the elderly or disabled. Hair can snag on the fasteners, and sitting or lying on the fasteners is uncomfortable. The garments without leg holes must be removed from the legs for walking, and the wearer must hold the lower end of the garment to avoid tripping.

OBJECTIVES OF THE INVENTION

Accordingly, the objectives of the present cocoon garment are:

- to provide warmth to the whole body while reading, watching television, or lounging around;
- to not uncover the body or fall off when the wearer shifts or walks;
- to be easy to put on or take off while sitting or lying down;
- to be comfortable to sit on or lie on;
- to warm the hands;
- to enable the wearer to walk while still wearing it;
- to enable the wearer to walk without having to hold the lower end of it;
- to be storable within its own pouch or foot pocket when not being worn; and
- to be usable as a decorative pillow for a bed or couch when rolled up.

Further objectives of the present invention will become apparent from a consideration of the drawings and ensuing description.

BRIEF SUMMARY OF THE INVENTION

The present cocoon garment is comprised of a tubular body continuously extending between a shoulder end and a feet end for fully covering the torso and legs. A neck opening is provided at the center of the shoulder end, and is cut lower at the front than at the back for comfort. A pair of sleeves are attached to opposite sides of the shoulder end for covering the arms. A center pocket is provided at the front of the tubular body, and includes openings on opposite sides for receiving the hands. A longitudinal slit is provided on the back of the tubular body for entry and exit, even when sitting or lying down. The slit is completely free of fasteners for comfort when sitting or lying on it. Since a person would be mostly sitting or lying down when wearing the garment, the slit does not need to be closed with fasteners anyway. The feet end is removed from the legs for walking. The loose feet end can be raised to avoid tripping by tying it to a higher portion of the garment with cords.

BRIEF DESCRIPTION OF THE SEVERAL VIEWS OF THE DRAWING

FIG. 3 is a side perspective view thereof being put on.

Figure 1:
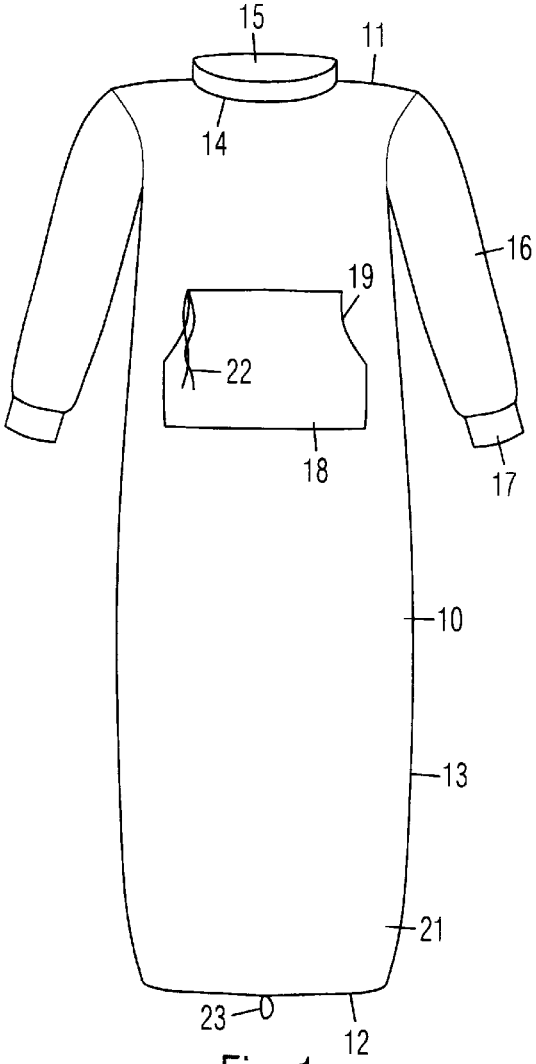
FIG. 1 is a front view of the present cocoon garment.

| DRAWING REFERENCE NUMERALS | |
|---|---|
| 10. Tubular Body | 11. Shoulder End |
| 12. Feet End | 13. Sides |
| 14. Neck Opening | 15. Collar |
| 16. Sleeves | 17. Cuffs |
| 18. Center Pocket | 19. Side Openings |
| 20. Slit | 21. Foot Pocket |
| 22. Cords | 23. Loop |
| 24. Slit | 25. Neck Opening |
| 26. Collar | 27. Neck Opening Closure |
| 28. Neck Band | 29. Fastener |
| 30. Fastener | |

DETAILED DESCRIPTION OF THE INVENTION

Figure 2:
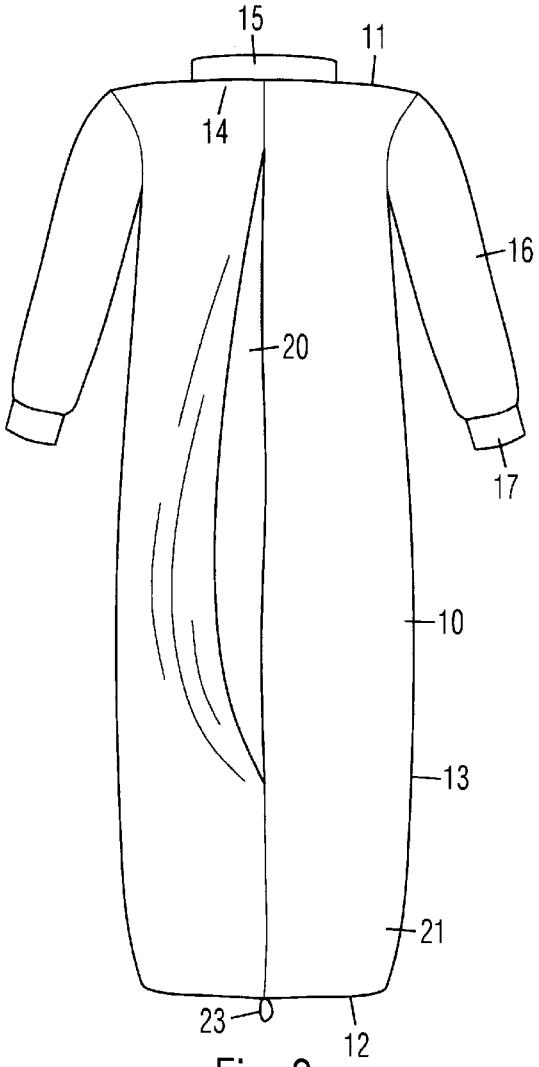
FIG. 2 is a back view thereof.
Figure 3:
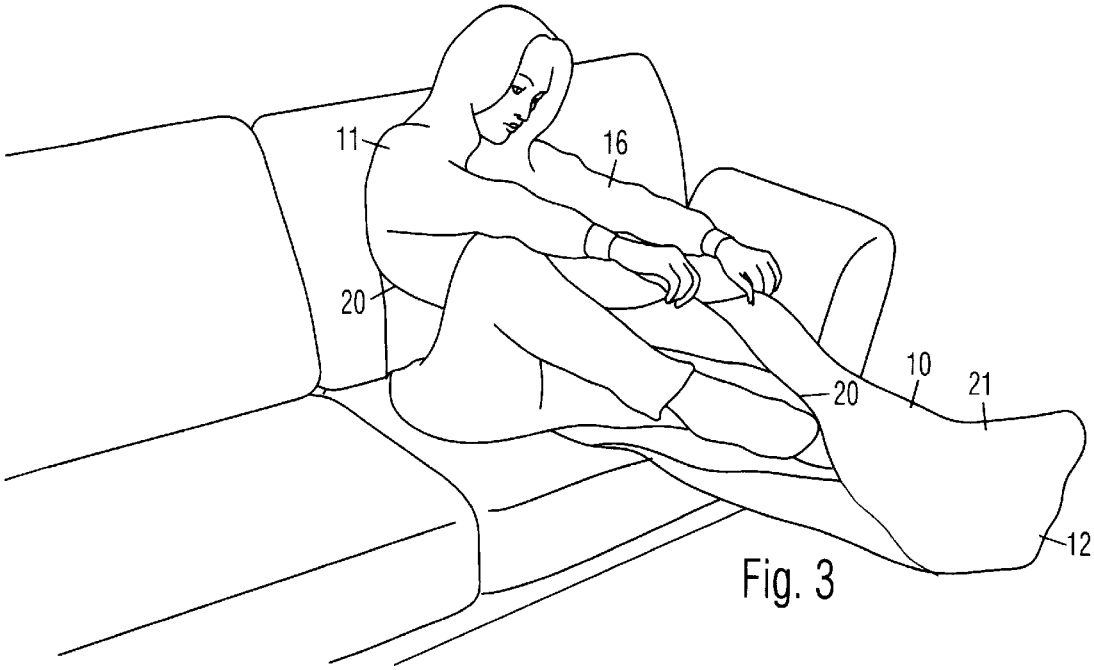

FIGS. 1–2:

A preferred embodiment of the present cocoon garment is shown in a front view in FIG. 1 and a back view in FIG. 2. It is comprised of a tubular body 10 continuously extending between a shoulder end 11 and a feet end 12 for fully covering the torso and legs. Tubular body 10 is closed along opposite sides 13. A neck opening 14 is provided at the center of shoulder end 11, and is cut lower at the front than at the back for comfort. Neck opening 14 is preferably permanently fixed in a loop, but it can include a closure at the back with a fastener, such as a button, snap, hooks-and-loops, etc. An optional collar 15 is attached to neck opening 14. A pair of sleeves 16 are attached to opposite sides of shoulder end 11 for covering the arms. Sleeves 16 are preferably long sleeves with narrowed cuffs 17. A center pocket 18 is provided at the front of tubular body 10, and includes side openings 19 for receiving the hands.

A longitudinal slit 20 is provided on the back of tubular body 10 for entry and exit. The top end of slit 20 is preferably about 3 inches below shoulder end 11, and the bottom end of slit 20 is preferably about 14 inches from above feet end 12. A foot pocket 21 is thus provided at feet end 12. The left side of slit 20 is shown partially opened. Because slit 20 is on the back, it is completely free of fasteners for comfort when sitting or lying on it. Feet end 12 is removed from the legs for walking. It can be raised by tying cords 22 at an upper portion of the garment to a loop 23 at feet end 12. Alternatively, cords 22 and loop 23 can be replaced with other types of fasteners, such as buttons, snaps, hooks-and-loops, etc.

FIG. 3:

In FIG. 2, the garment is put on by entering slit 20, putting the head through the neck opening and the arms through the sleeves, and putting the legs through slit 20 into foot pocket 21. Because slit 20 is on the back, the garment can be put on or taken off while sitting or lying down. This is very convenient, particularly for the elderly, disabled, bedridden, or anyone who has trouble getting up. There are no fasteners on the back, where they would otherwise be difficult to reach and use. Since the wearer would be mostly sitting or lying down on slit 20, no cold air can enter through it, so it does not need to be closed with fasteners anyway.

Figure 4:
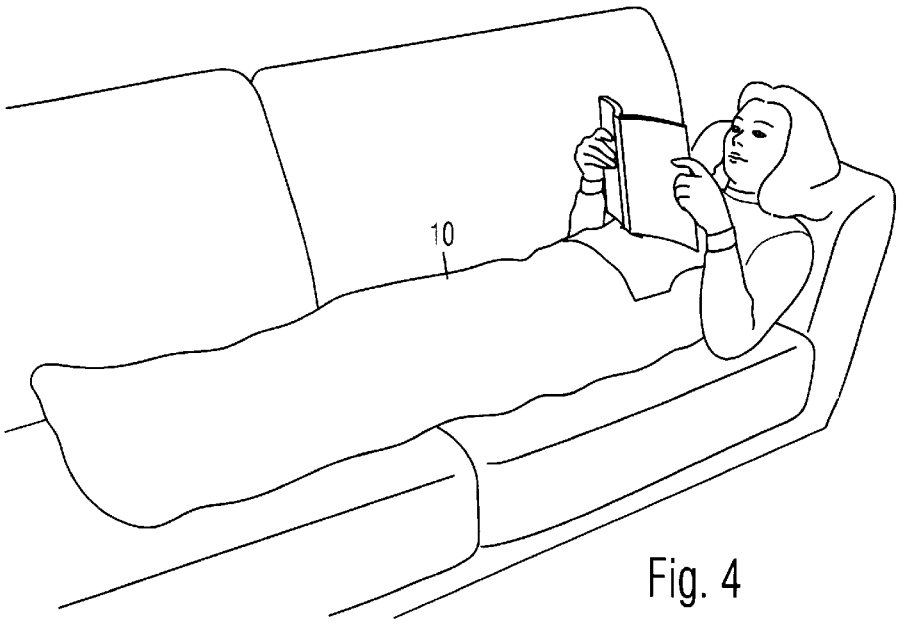
FIG. 4 is a side perspective view thereof in use.
Figure 5:
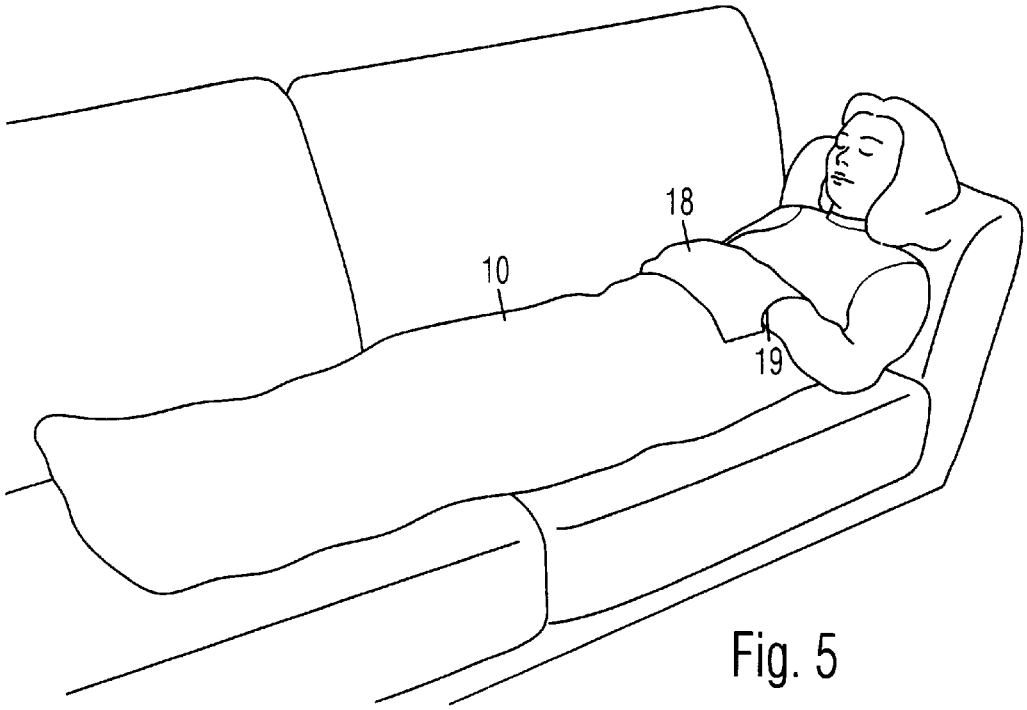
FIG. 5 is a side perspective view thereof in use.
Figure 6:
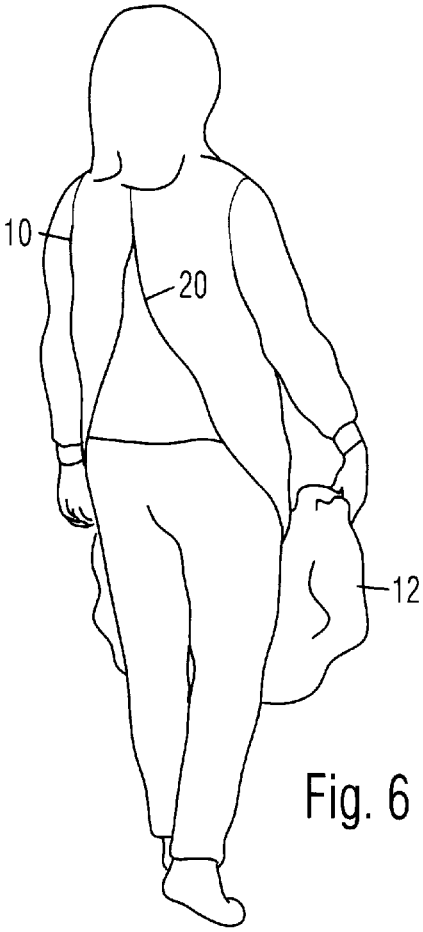
FIG. 6 is a rear perspective view thereof in use.

FIGS. 4–6:

The garment provides comfort and warmth while reading or lounging, as shown in FIGS. 4–5. Unlike a blanket, it will not uncover any part of the body or fall off when the wearer shifts or walks around. The hands are free for writing, handiwork, reading, etc. In FIG. 5, the hands are inserted into pocket 18 through side openings 19 to keep them warm. Unlike conventional separate side pockets, which are relatively small, center pocket 18 is big enough for holding various items, such as small books, cordless phones, television remote controls, etc. In FIG. 6, the wearer can walk while still wearing the garment by removing the legs from feet end 12. The loose feet end 12 can be held by hand to avoid tripping, or it can be attached to an upper part of tubular body 10 by tying cords 22 to loop 23 (FIG. 1).

Figure 7:
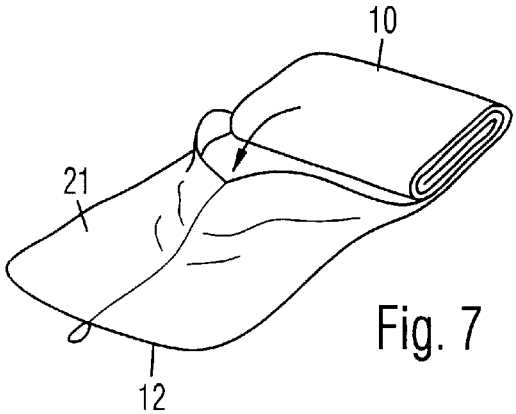
FIG. 7 is a side perspective view thereof being rolled up.
Figure 8:
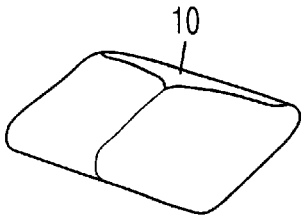
FIG. 8 is a side perspective view thereof completely rolled up.

FIGS. 7–8:

In FIG. 7, the garment is folded for storage from the shoulder end toward feet end 12, and stuffed into foot pocket 21. The folded garment can also be used a decorative pillow for a bed or couch, as shown in FIG. 8.

Figure 9:
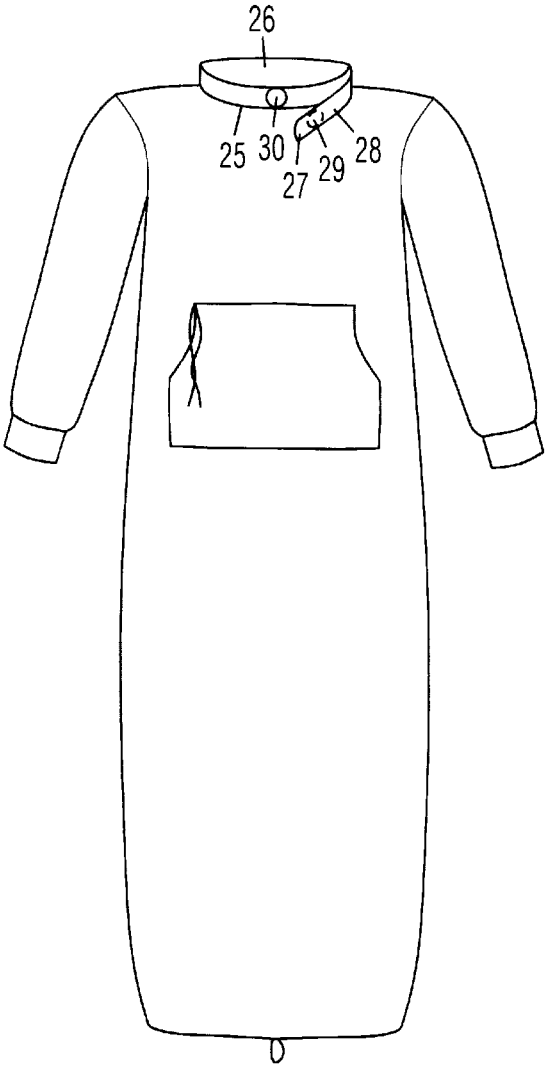
FIG. 9 is a front view of an alternative embodiment thereof.
Figure 10:
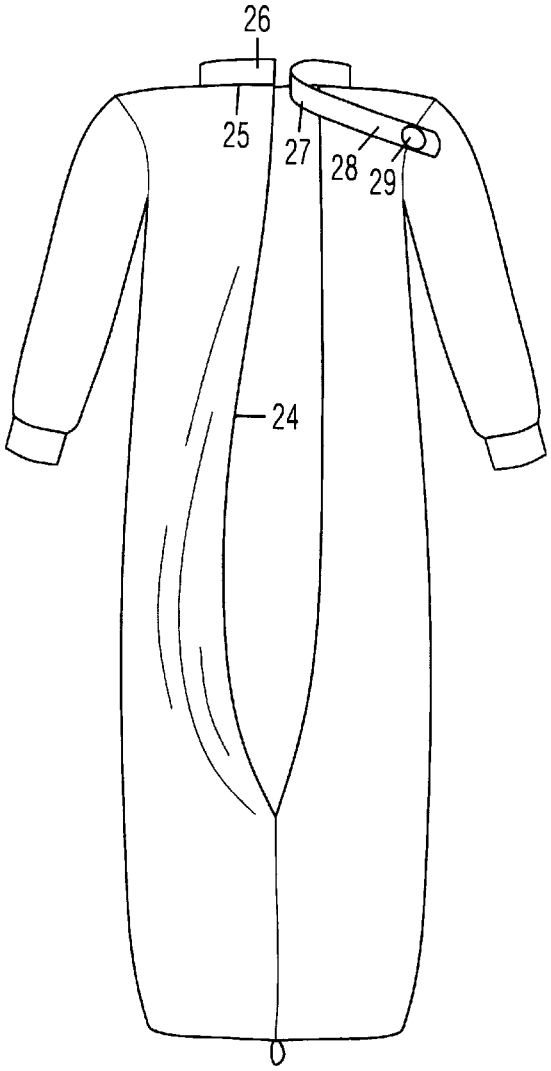
FIG. 10 is a rear view of the alternative embodiment.

FIGS. 9–10:

An alternative embodiment of the garment is shown in FIG. 9. It include a slit 24 which extends to the top edge of a neck opening 25 and a collar 26 to allow it to be put on or taken off without having it pulled over the wearer's head. This is particularly advantageous for the sick or elderly. A neck opening closure 27 is provided at neck opening 25 to close slit 24. Neck opening closure 27 is preferably comprised of a strap 28 extending from one side of slit 24, and a fastener 29 at the end of strap 28. Neck band 28 is long enough to wrap around to the front of collar 26 and secured to another fastener 30 at the front of collar 26. Having the fasteners connect at the front of the garment makes them much easier to operate.

SUMMARY AND SCOPE

Accordingly, the present cocoon garment provides warmth and comfort to the whole body while reading, watching television, or lounging around. It does not uncover the body or fall off when the wearer moves about or walks around. It is easy to put on or take off while sitting or lying down. It is comfortable to sit on or lie on. It warms the hands. It enables the wearer to walk while still wearing it. It enables the wearer to walk without having to hold the feet end of it. It is storable within its own pocket when not being worn. It is also usable as a decorative pillow for a bed or couch when rolled up into the pocket. It is great for keeping warm while studying, staying in a hospital, working on crafts, lounging on a cruise, watching a ball game, relaxing in a spa, flying in an airplane, sitting in a wheelchair, reading, snuggling, napping, sleeping. It is also great as a promotional giveaway.

Although the above description is specific, it should not be considered as a limitation on the scope of the invention, but only as an example of the preferred embodiment. Many variations are possible within the teachings of the invention. For example, the garment can be made in a variety of fabric type materials. It can be made is a variety of sizes. The relative positions and shapes of the elements can vary. It may be provided with surface indicia, such as crests, logos, emblems, etc. Therefore, the scope of the invention should be determined by the appended claims and their legal equivalents, not by the examples given.

I claim:

1. A cocoon garment, comprising:

a tubular body closed along opposite sides and continuously extending between a shoulder end and a feet end for fully covering a torso and legs of a wearer;

wherein said feet end is closed for warmth;

a neck opening provided at said shoulder end, wherein said neck opening is cut lower at a front of said tubular body than at a back of said tubular body for comfort;

a pair of sleeves attached to opposite sides of said shoulder end for covering a pair of arms which are free for working; and a longitudinal slit provided on said back of said tubular body for entry and exit, since said slit is on said back of said tubular body, said garment is adapted to be put on or taken off while sitting or lying down;

wherein a bottom end of said slit is spaced above said feet end to form a foot pocket at said feet end;

wherein when said garment is not being worn, said garment can be folded and stored in said foot pocket;

where said neck opening is closed with a detachable neck opening closure, whereby said garment can be put on or taken off without being pulled over the head of said wearer, said neck opening closure is comprised of a strap connected to a back of said neck opening, and is long enough to be secured to a front of said neck opening.

2. A cocoon garment, comprising:

a tubular body closed along opposite sides and continuously extending between a shoulder end and a feet end for fully covering a torso and legs of a wearer;

wherein said feet end is closed for warmth;

a neck opening provided at said shoulder end, wherein said neck opening is cut lower at a front of said tubular body than at a back of said tubular body for comfort;

a pair of sleeves attached to opposite sides of said shoulder end for covering a pair of arms which are free for working;

a longitudinal slit provided on said back of said tubular body for entry and exit, since said slit is on said back of said tubular body, said garment is adapted to be put on or taken off while sitting or lying down;

wherein said slit is completely free of fasteners below a top end thereof for comfort when said wearer is sitting or lying on said slit;

wherein a bottom end of said slit is spaced above said feet end to form a foot pocket at said feet end;

wherein when said garment is not being worn, said garment can be folded and stored in said foot pocket;

a center pocket provided at said front of said tubular body, said center pocket including side openings for receiving a pair of hands; and a first fastener at an upper portion of said tubular body, and a second fastener adjacent said feet end, wherein said first fastener and said second fasteners can be connected together to raise said feet end for walking;

wherein said neck opening is closed with a detachable neck opening closure, whereby said garment can be put on or taken off without being pulled over the head of said wearer, said neck opening closure is comprised of a strap connected to a back of said neck opening, and is long enough to be secured to a front of said neck opening.

* * * * *